US006804913B2

(12) United States Patent
Pipin

(10) Patent No.: US 6,804,913 B2
(45) Date of Patent: Oct. 19, 2004

(54) WINDOW STRUCTURE

(75) Inventor: Frederick L. Pipin, Chicago, IL (US)

(73) Assignee: The Kewanee Corporation, Kewanee, IL (US)

( * ) Notice: Subject to any disclaimer, the term of this patent is extended or adjusted under 35 U.S.C. 154(b) by 0 days.

(21) Appl. No.: 10/166,834

(22) Filed: Jun. 11, 2002

(65) Prior Publication Data

US 2003/0226316 A1 Dec. 11, 2003

(51) Int. Cl.[7] ..... E05D 15/58; E06B 3/00
(52) U.S. Cl. ..... 49/260; 52/204.5
(58) Field of Search ..... 49/260, 254, 257, 49/178, 258, 179, 176–177, 445, 181, 364, 449; 52/207, 204.51, 204.5

(56) References Cited

U.S. PATENT DOCUMENTS

| | | | | | |
|---|---|---|---|---|---|
| 4,222,201 | A | * | 9/1980 | Yanessa | 49/189 |
| 4,337,597 | A | * | 7/1982 | Struckmeyer | 49/256 |
| 4,559,739 | A | * | 12/1985 | Bayer | 49/177 |
| 4,592,168 | A | * | 6/1986 | Struckmeyer | 49/177 |
| 4,888,915 | A | * | 12/1989 | Goldenberg | 49/181 |
| 5,058,321 | A | * | 10/1991 | Harbom et al. | 49/177 |
| 5,065,544 | A | * | 11/1991 | Martin | 49/177 |

* cited by examiner

*Primary Examiner*—Hugh B. Thompson, II
(74) *Attorney, Agent, or Firm*—Niro, Scavone, Haller & Niro

(57) ABSTRACT

A double-paned, side-by-side sash window has two sashes that independently slide and pivot to present differently sized openings.

6 Claims, 4 Drawing Sheets

WINDOW STRUCTURE

FIELD OF THE INVENTION

The present invention relates to window structures and particularly to window structures adapted for basement windows.

BACKGROUND OF THE INVENTION

Basement windows face physical and regulatory limitations not shared by other windows. Physically, the fact that much of a typical basement is below ground level means that basement windows are restricted as to height, and generally are wider than they are high, in contrast to most other windows. This means that the basement window is either a single pane window or, if it is double paned, uses side by side panes that slide laterally, rather than, for example, double hung sash windows that open up and down or casement windows that open outwardly.

A regulatory limitation that arises is that many building codes including IRC 2000 require that at least one basement window provide a large enough aperture when opened so that people can escape through the window in an emergency, for example, fire. If the basement window is single paned, that single pane would have to open out or in, and the size required of the single pane may make it unwieldy and expensive. Even if the basement window is side by side double paned, so that one pane could be slid over the other, the size of each pane would still have to match the necessary aperture, making both panes large and expensive and the sliding pane heavy.

Accordingly, there is a need for an improved window structure adapted for use as a basement window that is inexpensive, easy to use and provides the necessary aperture to function as an emergency exit.

OBJECTS AND SUMMARY OF THE INVENTION

It is therefore an object of the present invention to provide a window structure that avoids the above-identified difficulties of the prior art.

It is a further object of the present invention to provide a window structure usable as a basement window that provides the emergency escape aperture required by law without requiring large, heavy and/or expensive window panes.

In accordance with these and other objects, a window structure in accordance with the present invention comprises a generally rectangular left sash having top, bottom, left side and right side sides, with a first window pane mounted therein, and a corresponding generally rectangular right sash having top, bottom, left side and right side sides, with a second window pane mounted therein. The window structure further comprises a window frame defining a window aperture and supporting the left and right sashes in each of a plurality of positions including respective closed positions wherein the left and right sashes are in side-by-side relation to completely close the window aperture with the right side of the left sash confronting the left side of the right sash.

In accordance with the present invention, the left sash is independently slidable rightward within the frame away from the respective closed position to an open-left position to present an opening between the frame and the left side of the left sash, and the right sash is correspondingly independently slidable leftward.

Moreover, with the left side of the left sash abutting the left side of the frame, the left sash is independently pivotal about its left side to a first open-center position wherein the right side of the left sash is spaced away from the frame, and the right sash is correspondingly independently pivotal about its right side to a second open-center position wherein the left side of the right sash is spaced away from the frame, the left sash at the first open-center position and the right sash at the second open center position presenting a center opening substantially coextensive with the window aperture.

These and other features, aspects and advantages of the present invention will be apparent from the following description of the preferred embodiments taken together with the accompanying drawings.

DETAILED DESCRIPTION OF THE PREFERRED EMBODIMENTS

Figure 1:
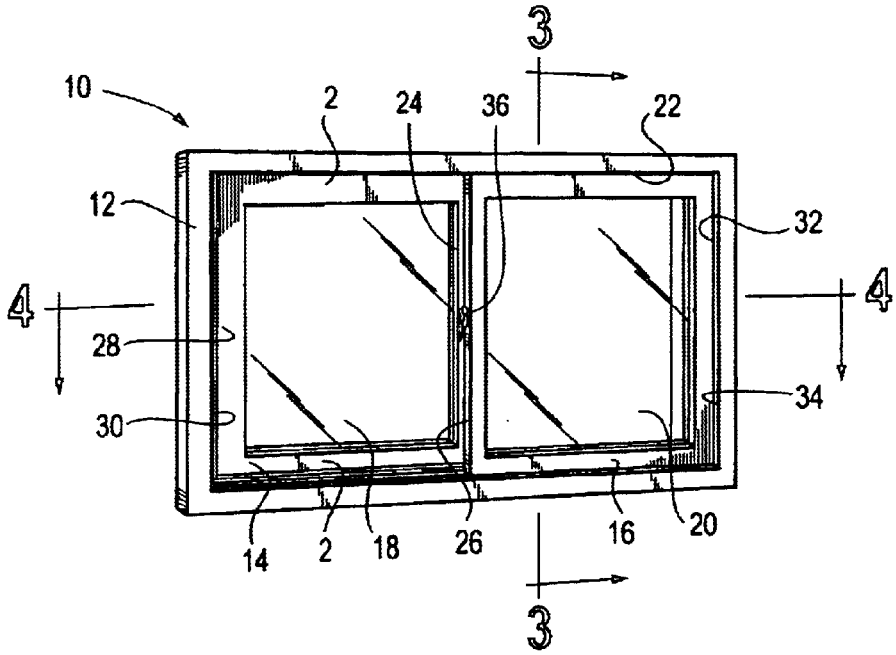
FIG. 1 is an elevational view of a preferred embodiment of the window structure in accordance with the present invention with its sashes in their respective closed positions.

FIG. 1 illustrates the novel window structure of the present invention as a double-paned, side-by-side sash window 10. The window 10 includes a frame 12 having mounted therein a left sash 14 and a right sash 16. The left sash 14 conventionally supports therein a window panel 8, and the right sash 16 correspondingly supports a window pane 20, each window pane 18, 20 being of any appropriate type. In FIG. 1, each of the sashes 14, 16 is shown in its respective closed position so that the two sashes 14, 16 in combination completely span and close the aperture 22 defined by the inner perimeter of the frame 12.

In the closed positions, the left and right sashes 14, 16 are in side-by-side relation with the right side 24 of the left sash 14 confronting the left side 26 of the right sash 16, either edge to edge or overlapping, as is conventional. Similarly, the left side 28 of the left sash 14 abuts the left inner side 30 of the frame 12, and the right side 32 of the right sash 16 abuts the right inner side 34 of the frame 12.

As is conventional with side-by-side sash windows, each of the left and right sashes 14, 16 can slide within the frame 12 away from its respective closed position. Thus, the left sash 14 is independently slidable rightward within the frame 12 away from its closed position to an open left position to present an opening between the left inner side 30 of the frame 12 and the left side 28 of the left sash 14. Correspondingly, the right sash 16 is independently slidable leftward within the frame 12 away from its closed position to an open right position to present an opening between the right side 34 of the frame 12 and the right edge 32 of the right sash 16.

As in conventional vertical double hung windows, advantageously each sash 14, 16 can slide away from its closed position all the way to the opposite side of the frame 12, overlapping or even passing the other sash. Alternatively, the sashes 14, 16 may be designed to stop once they completely overlap.

A conventional lock (or locks) 36 connects the right side 24 of the left sash 14 to the left side 26 of the right sash 16 to hold the two sashes in their closed positions. The lock(s) 36 can be opened to permit sliding of either or both sashes away from their closed positions.

It will be seen that the sliding movement of either or both of the two sashes 14, 16 can present at most an opening equal in size to one sash, i.e. approximately half of the window aperture 22. However, in accordance with an advantageous feature of the present invention, the sashes 14, 16 can not only slide, but can also pivot out to respective open-center positions to present a center opening substantially coextensive with the window aperture 22.

Figure 2:
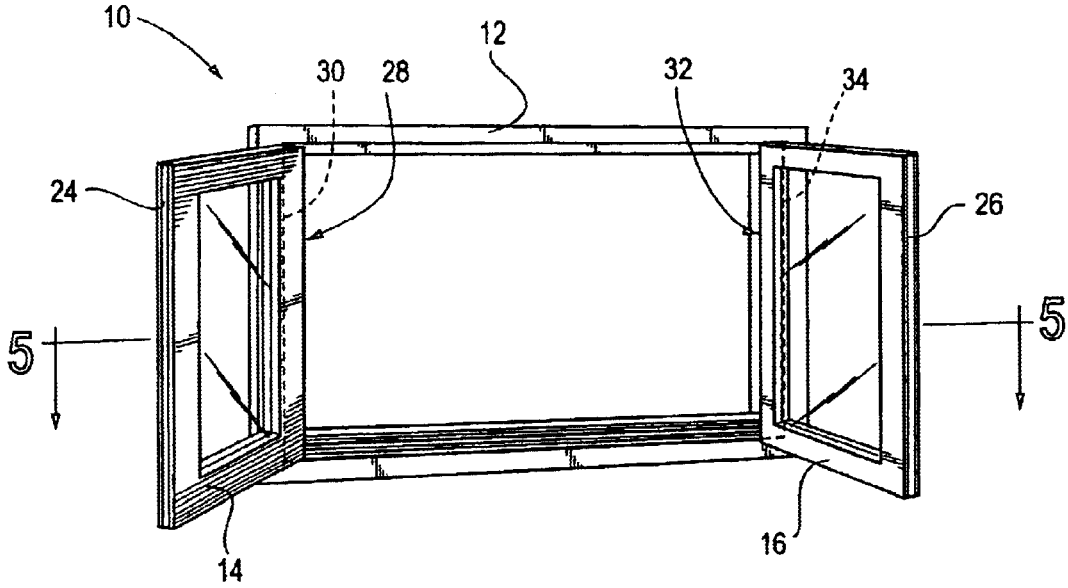
FIG. 2 is an elevational view of the window structure of FIG. 1 with its sashes in their respective center-open positions.

Specifically, as shown in FIG. 2, with the left side 28 of the left sash 14 abutting the left inner side 30 of the frame 12, the left sash 14 is independently pivotal about its left side 28 to a first open-center position wherein the right side 24 of the left sash 14 is spaced away from the frame 12. Correspondingly, with the right side 32 of the right sash 16 abutting the right inner side 34 of the frame 12, the right sash 16 is independently pivotal about its right side to a second open-center position wherein the left side 26 of the right sash 16 is spaced away from the frame 12.

In accordance with the present invention, therefore, the left sash 14 at the first open-center position and the right sash 16 at the second open center position present the center opening substantially coextensive with the window aperture 22, not approximately one half thereof. Accordingly, if the window aperture 22 is designed to meet the regulatory size, each sash and its mounted window pane need be only approximately one half that size. This means that the sashes 14, 16 can be lighter, easier to move and less expensive.

Figure 4:
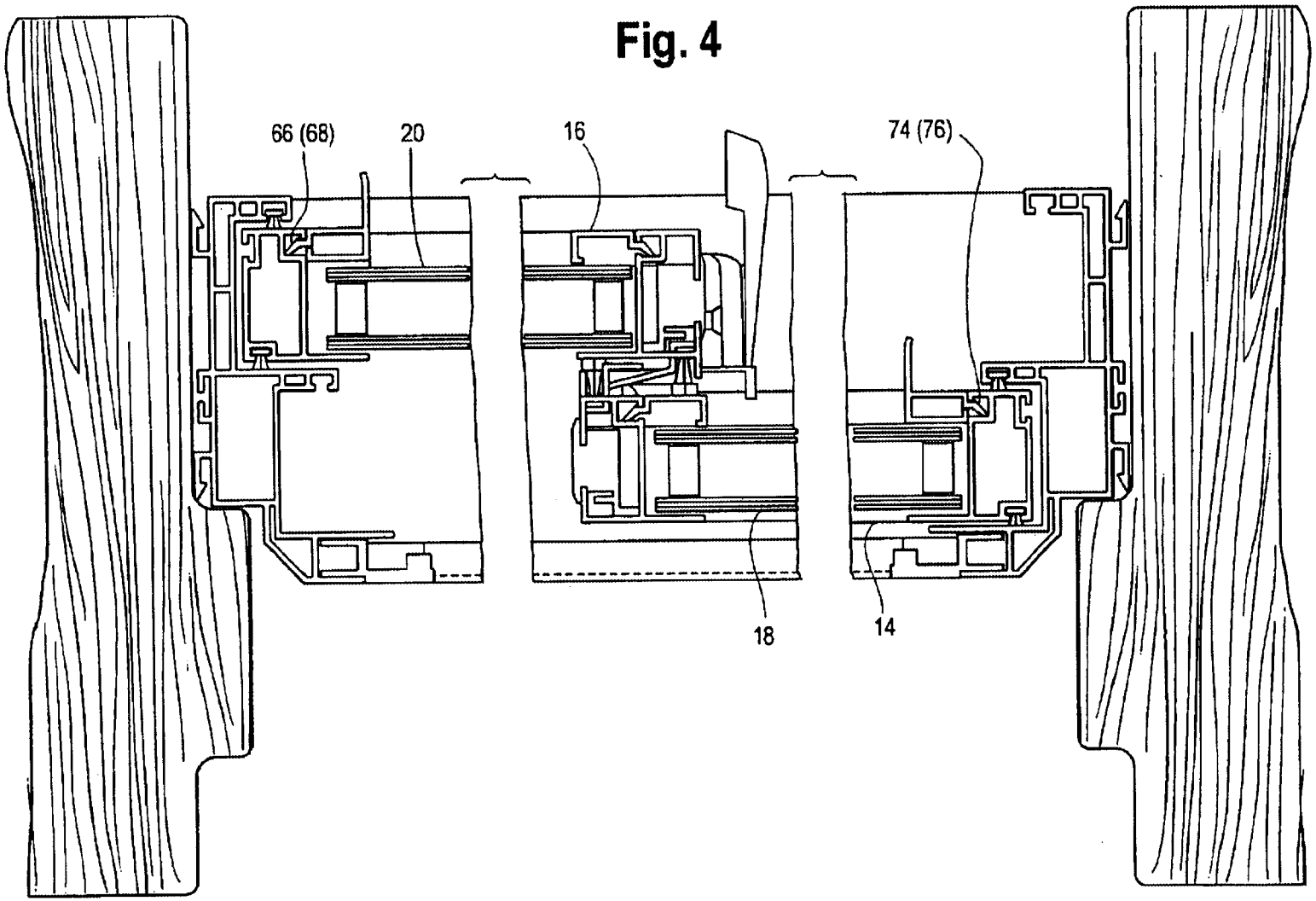
FIG. 4 is a first partial horizontal cross-sectional view of the window structure taken along line A—A in FIG. 1.
Figure 5:
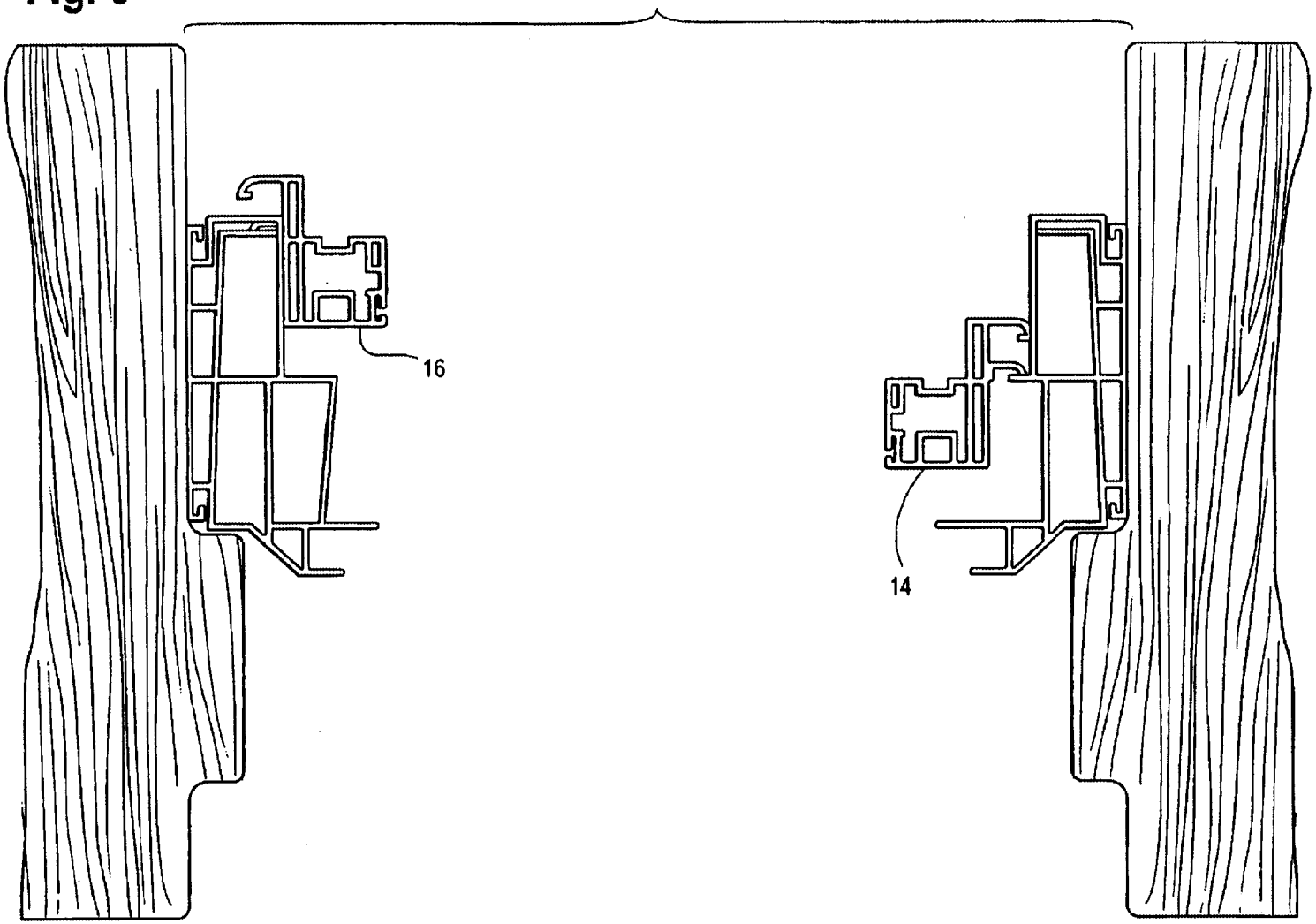
FIG. 5 is a second partial horizontal cross-sectional view of the window structure taken along line C—C in FIG. 2.

Advantageously, the pivot mechanism for each sash can basically have the same construction as the conventional tilt mechanism used for vertically double-hung sash windows to tilt those sashes inward for cleaning from the inside of the room. While this tilt mechanism is well known, it will be described below in connection with FIGS. 3–5, illustrating the modifications of the mechanism for the novel window 10.

Figure 3:
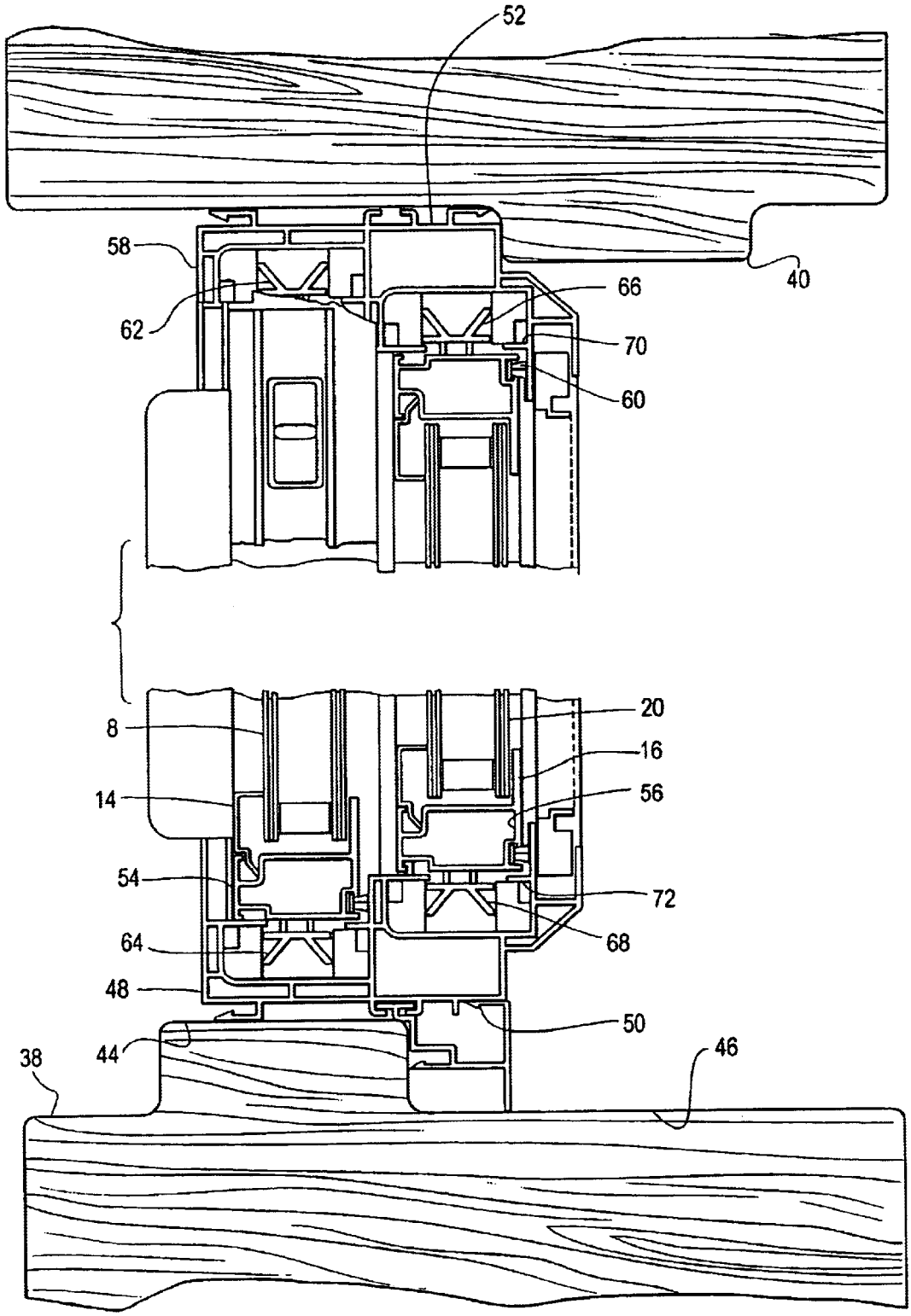
FIG. 3 is a partial vertical cross-sectional view of the window structure taken along line B—B in FIG. 1.

FIG. 3 is a vertical section taken along line B—B in FIG. 1, where the right side 24 of the left sash 14 and the left side 26 of the right sash 16 overlap. FIG. 3 is a partial cross-section because the center portion (which is simply an extension of the sash sides) has been omitted for clarity. FIG. 3 is further in partial cutaway to show the pivot mechanism, as described below.

As shown in FIG. 3, the frame 12 includes a lower window sill 38 and an upper lintel 40. In this illustration, the window sill 38 has a base 42 having first and second horizontal levels 44, 46. A sill extrusion 48 of the left sash 14 is mounted to the first, upper level 44 and the right sash 16 is mounted to the second level 46 through a sill adaptor extrusion 50 with a weather seal. The head extrusion 52 for the sashes 14, 16 is mounted to the lintel 40.

Each sash 14, 16 includes a conventional bottom rail extrusion 54, 56 and top rail extrusion 58, 60 along which the respective sash slides.

Advantageously, each sash 14, 16 includes a pivot mechanism including upper and lower pivot shoes, each with a respective cam, for enabling the pivotal movement. Thus, sash 14 includes upper pivot shoe 62 and lower pivot shoe 64, and sash 16 includes upper pivot shoe 66 and lower pivot shoe 68. As shown with pivot shoes 66, 68, each of the four pivot shoes is adapted to pivot about a corresponding pivot bar 70, 72 mounted within the frame 12 and sashes 14, 16 at the corresponding upper or lower, left or right side. As shown in FIG. 4, each sash further includes one or more respective tilt latches, e.g. tilt latches 74 for left sash 14, and tilt latches 76 for right sash 16, which can be locked to prevent pivotal movement or unlocked to permit pivotal movement.

FIGS. 4 and 5 are partial horizontal views respectively showing the sashes 14, 16 in their closed positions and in their center open positions. FIG. 4 is taken along line A—A in FIG. 1, and illustrates the pivot shoes 66, 68 of the right sash 16 and the pivot shoes 62, 64 of the left sash 14 in their normal positions within the frame 12 holding the sashes in position for sliding motion.

FIG. 5 is taken along line C—C in FIG. 2, but has been simplified by omitting various elements, including the sash/pane structure, to illustrate the pivot shoes when the tilt latches have been released and the sashes 14, 16 have been pivoted to their center-open positions. Of course, the sashes 14, 16 can be at any intermediate positions between their respective closed and center-open positions as the sashes are swung in.

The window 10 advantageously is sized to fit any standard window opening, or may be custom sized. Thus, it can be used as a replacement window or for new installations. While it is ideal for basement windows, it can be used wherever the allowable height of the window is limited or where any double paned, side-by-side sash window is desired. The window 10 accommodates a heavy duty cam lock and keeper for security, with two secure metal top latches. The window 10 can also accommodate full size removable screens.

It will be understood that while the window has been described as opening in, it may also be constructed to open out.

Thus, the present invention provides a window structure with many advantages not found in conventional windows. The novel window structure has a reduced height, suitable for basement windows and other windows where a limited height is permitted, and yet it provides convenient slide opening and practical pivot opening both for cleaning and for presenting the large window opening substantially coextensive with the window aperture.

While the present invention has been described with reference to the foregoing embodiments, changes and variations may be made therein which fall within the scope of the appended claims.

I claim:

1. A window structure comprising:

a generally rectangular left sash having top, bottom, left side and right side sides;

a first window pane mounted in said left sash;

a generally rectangular right sash having top, bottom, left side and right side sides;

a second window pane mounted in said right sash;

a window frame having a right side, a left side, a top portion, and a bottom portion defining a window aperture and supporting said left and right sashes in each of a plurality of positions including respective closed positions wherein said left and right sashes are in side-by-side relation to completely close said window aperture with said right side of said left sash confronting said left side of said right sash;

said left sash being independently slidable rightward within said frame away from the closed position to an open-left position to present an opening between said frame and said left side of said left sash;

said right sash being independently slidable leftward within said frame away from the closed position to an open-right position to present an opening between said frame and said right side of said right sash;

said left sash, with said left side thereof abutting said left side of said frame, being independently pivotal about its left side to a first open-center position wherein said left side of said left sash is spaced away from said frame;

said right sash, with said right side thereof abutting said right side of said frame, being independently pivotal abut its right side to a second open-center position wherein said left side of said right sash is spaced away from said frame; and said left sash at said first open-center position and said right sash at said second open center position presenting an unobstructed opening between the right and left sides of the window frame, and the top and bottom portions aperture of said window frame.

2. The window structure of claim 1, wherein said frame includes a top left pivot bar, a bottom left pivot bar, a top right pivot bar and a bottom right pivot bar, wherein said left sash has a first pivot structure including a top pivot shoe for receiving said top left pivot bar and a bottom pivot shoe for receiving said bottom left pivot bar, and wherein said right sash has a second pivot structure including a top pivot bar receiving mechanism for receiving said top right pivot bar and a bottom pivot shoe for receiving said bottom right pivot bar.

3. The window structure of claim 1, wherein said window structure is a basement window structure.

4. The window structure of claim 1, wherein said left and right sashes pivot inwardly.

5. The window structure of claim 1, further comprising a releasable lock for holding said left and right sashes at their respective closed positions from sliding.

6. The window structure of claim 1, further comprising at least one releasable tilt latch for holding each of said left and right sashes at their respective closed positions from pivoting.

* * * * *